United States Patent [19]

Schwarting et al.

[11] Patent Number: 4,458,950

[45] Date of Patent: Jul. 10, 1984

[54] ENERGY SUPPLY UNIT FOR WINNING MACHINES PULLED BY A TRACTION MECHANISM FOR MINING OPERATIONS

[75] Inventors: Karl H. Schwarting, Voerde; Josef Aholt, Ringenberg; Karl H. Herrmann, Oberhausen; Hans Johenning, Oberhausen; Willi Küpper, Oberhausen; Aloys Weingarten, Isselburg; Bolko Kleinert, Kaarst, all of Fed. Rep. of Germany

[73] Assignee: M.A.N. Maschinenfabrik Augsburg-Nürnberg Aktiengesellschaft, Fed. Rep. of Germany

[21] Appl. No.: 386,343

[22] Filed: Jun. 8, 1982

[30] Foreign Application Priority Data

| | | | |
|---|---|---|---|
| Jun. 13, 1981 | [DE] | Fed. Rep. of Germany | 3123569 |
| Jan. 9, 1982 | [DE] | Fed. Rep. of Germany | 3200449 |
| Feb. 10, 1982 | [DE] | Fed. Rep. of Germany | 3204496 |

[51] Int. Cl.[3] ..... E21C 29/14

[52] U.S. Cl. ..... 299/43; 299/34

[58] Field of Search ..... 299/42-50, 299/34

[56] References Cited

U.S. PATENT DOCUMENTS

| | | | |
|---|---|---|---|
| 3,113,763 | 12/1963 | Wendt et al. | 299/43 |
| 4,088,370 | 5/1978 | Jarvis et al. | 299/43 |
| 4,103,974 | 8/1978 | Nowacki et al. | 299/43 |

FOREIGN PATENT DOCUMENTS

| | | | |
|---|---|---|---|
| 1012432 | 12/1965 | United Kingdom | 299/49 |

*Primary Examiner*—Ernest R. Purser

*Attorney, Agent, or Firm*—McGlew and Tuttle

[57] ABSTRACT

A device for extending supply lines to winning machines in mining operations comprises a traction chain housing which includes a covered guide for a traction member such as an endless conveyor chain. The traction member rides in the housing and is preferably covered thereby both in respect to its upper and lower reaches. A supply line support bar is secured to the traction members at spaced locations along its length for movement therewith and has a forked support extending outwardly from the housing which has one leg portion defining a support over which the supply lines are laid and another leg portion covering the supply lines. The device may be made with an endless chain conveyor which has upper and lower reaches as well as a chain conveyor having side by side reaches and in each case the housing or a cover for the housing provides for the lateral extension of the forked portion of the supply line support bar.

14 Claims, 9 Drawing Figures

ENERGY SUPPLY UNIT FOR WINNING MACHINES PULLED BY A TRACTION MECHANISM FOR MINING OPERATIONS

FIELD AND BACKGROUND OF THE INVENTION

This invention relates in general to mining and in particular to a new and useful device for extending supply lines to winning machines in mining operations.

The invention concerns an energy supply unit for winning machines pulled by a traction mechanism in mining operations, where the winning machine is pulled back and forth on the longwall conveyor along the head end, the supply lines are stored at the ends of the working face and deposited on the traction mechanism in a housing secured on the longwall conveyor, with supporting bars for depositing the supply lines secured symmetrically or asymmetrically on the traction mechanism of the winning machine, these supporting bars forming a right angle with the axis of the traction mechanism, and where furthermore several supply lines are deposited in juxtaposition or superposition on the supporting bars.

A mineral extraction machine which is drawn across the longwall at a coal face is, as a rule, guided on a work face conveyor. Drive for the machine is effected through traction means driven from the work face side of the conveyor. The required drive and operating means are supplied to the extraction machine by means of lines either in the form of loops by a cable trolley, with deflecting rollers, guided in a cable channel arranged in the work face conveyor or dragged by the extraction machine itself in a cable channel, possibly with the use of a cable chain. At higher propulsion speeds of the extraction machine, these feed arrangements causes difficulties. Jerky loadings occur, which lead to pronounced lateral and/or vertical deflection of the lines. The overall height of the cable channels therefore become unacceptable for low longwalls. Also the risk of fatigue fractures increase through frequent bending of the lines below the minimum bending radius, especially with low work faces. In the case of drag lines, a relatively high resistance to movement of the lines sliding on the stationary base also appears and contributes to a reduction in the life of these lines. Cable chains, moreover, produce an appreciable noise nuisance in mine workings.

In German Pat. No. 1,247,995 it is proposed to deposit the supply lines on the traction means of the extraction machine. In that case, and according to German Pat. No. 1,242,541, the lines are stored on or dispensed by drums positioned in head drifts or tunnels connected to the longwall. Although the lines are in this case largely relieved of tension forces, they are pressed against the ceiling and wall of a guide channel which is closed at the top, when the lines are traveling through troughs and are being unreeled in the case where a tautly tensioned drag chain is used. This means increased line wear through abrasion and damage of the lines through squeezing. The tractive or load run of the traction means slides on the floor and thereby increases the resistance to movement. Moreover, only one supply line at a time can be deposited in the guide channel on the traction means away from the extraction machine in both work face directions. In addition, electrical lines cannot be pushed within the guide channel for reasons of safety against firedamp. Accordingly, the cable must be guided out through a slot, which is not possible in the case of the equipment of German Pat. No. 1,242,541, because the clear width of the slot is smaller than the diameter of the energy supply line.

SUMMARY OF THE INVENTION

The invention improves the guidance and the protection of the power supply lines for mining devices so that the lines are secured against jumping out from the deposited position. In addition, the problem-free feeding and removal of the supply lines to and from the supporting bars, or strips on which the supply lines are deposited, is ensured.

According to the present invention there is provided mining equipment comprising conveying means for conveying extracted material from a work face, an extraction machine guided at the conveying means to be movable along the work face, traction means for moving the machine along the work face, the traction means being provided with support elements, and at least one supply line for supplying operating energy to the machine, the supply line being dispensed from storage means positionable at an end of the work face and being supported by the support elements in a housing connected to the conveying means.

These support elements, which can be arranged symmetrically or asymmetrically to the traction means, preferably form a right angle to the traction means axis and are guided in longitudinally extending guide grooves or guide channels in the housing. By preference, these channels comprise an upwardly open guide channel for an upper run of the traction means and a downwardly open guide channel for a lower run. Through this arrangement it is possible to arrange several supply lines alongside each other and/or one above the other in a guide channel of the traction means without inducing damaging stress. Through the lateral guides of the support elements in the upper run as well as in the lower run, guidance of the traction means is possible with only small frictional resistances. The supply line or lines can, without difficulties, be guided out of the guide channel to the extraction machine in the region of a guide carriage thereof. In the region of the extraction machine the upwardly open guide channel is preferably protected by a cover plate, which is articulatedly fastened to and entrained by the extraction machine against being filled with extracted material. Any fine material which ingresses into the guide channel is conveyed towards the work face end and carried out at that point.

To improve the guidance and provide an impact-preventing enclosure of the traction means as well as improve guidance and protection of the supply lines and ensure guidance of the extraction machine in such a manner that the weight and moment load is optimally absorbed by the housing, the housing is preferably constructed as a gutter provided with guide channels therein arranged horizontally beside each other for load and return runs of the traction means, these channels being covered by a cover detachably fastened to the gutter. Conveniently, the extraction machine can be guided in two tracks of the gutter.

Through construction of the housing in the form of a gutter with channels alongside each other, a low mode of construction favorable for low seam heights results, and a large floor support area is provided, whereby the areal pressure is reduced and the gutter will sink only minimally into the floor under the loading of the extraction machine guided over a wide track.

Due to the fact that the gutter is closed downwardly, extracted mineral cannot be entrained by the traction means.

The traction means, for example a chain, is easily accessible and may be taken out without difficulties. Because the traction means is enclosed, the chain cannot whip around in case of breakage and endanger personnel.

Further advantages result from the fact that all screws, which serve for the fastening of the gutter shaped housing to the work face conveying means and the cover to the housing, may be accessible from above. Moreover, weakening of the parts to be connected is not produced by such fastening screws.

Even with the supply lines, for example cables and houses, deposited in a gutter on the support elements or strips of an endless chain circulating at the work face, there can be difficulties in the case of a wavy course of the seam and in the case of lines prestressed in longitudinal direction, in that the lines may jump out of the deposit location on the support elements.

Thus, according to another feature of the invention, the supporting bars for depositing the supply lines secured on the traction mechanism are designed as forked carriers, and scissor-type guideways are arranged on the housing for the traction mechanism and the supply lines for threading the supply lines in and out of the forked supporting bars.

The forked carriers embrace the supply lines deposited thereon. The upper leg of the fork prevents lines from jumping out of the line guide when the traction mechanism passes through saddles, depressions or curves.

The design of the carriers as a fork makes it possible to remove the supply lines on the movable winning machine and, in combination with the scissor-type guideways, to thread the lines in and out of the heat road to wind the lines on a cable or hose drum or to unwind them.

Accordingly, it is another object of the invention to provide a device for expanding supply lines to winning machines in mining operations which comprises a traction member housing including a guide for a traction member and with a traction member riding in the guide further including a supply line support bar secured to the traction member for movement therewith and having a fork support extending outwardly from the traction member with one leg defining a support over which the supply lines are laid and with another leg portion covering the supply lines.

A further object of the invention is to provide a device for distributing supply lines to a winning machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
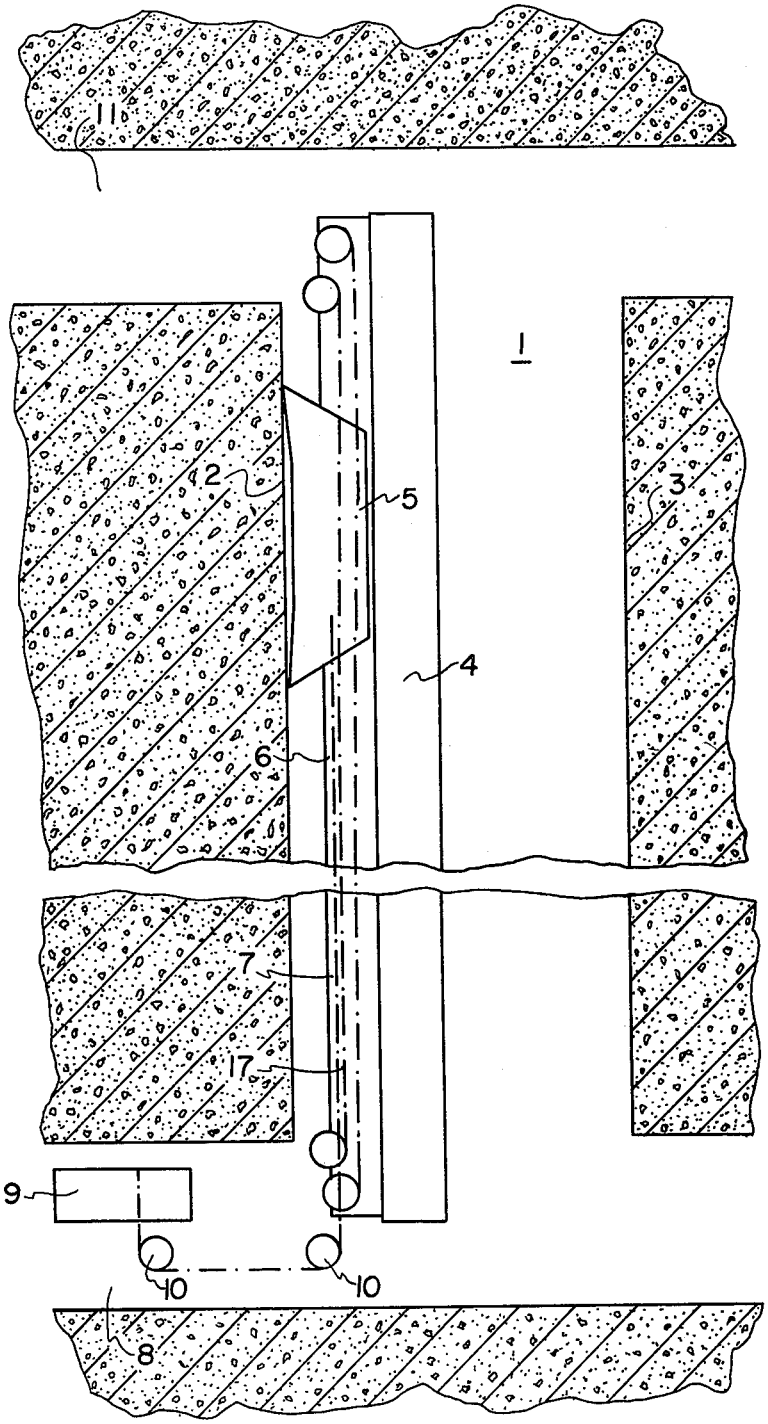
FIG. 1 is a schematic plan view of the layout of a mine with mining equipment according to the invention.

Referring now to the drawings, in FIG. 1 there is shown a longwall 1 with a coal face 2 and backfilling or waste side 3 of a mine. Arranged at the coal face 2 is a conveyor 4, by which an extraction or winning machine 5 is guided. Arranged on the face side of the conveyor 4 is a housing 6, in which traction means or member 17, for example a chain, of the machine 5 and an energy supply line 7 are guided. The supply line 7 is reeled up on and dispensed from a cable or hose drum 9 in a head drift or tunnel 8. The deflection of the line 7 from the longwall 1 to the headrift 8 takes place through deflecting rollers 10. When several supply lines are present, these can be reeled up on several different drums or additionally be fed from the other head drift 11. Throughout the drawings, the same numbers are used to designate the same or similar parts.

Figure 2:
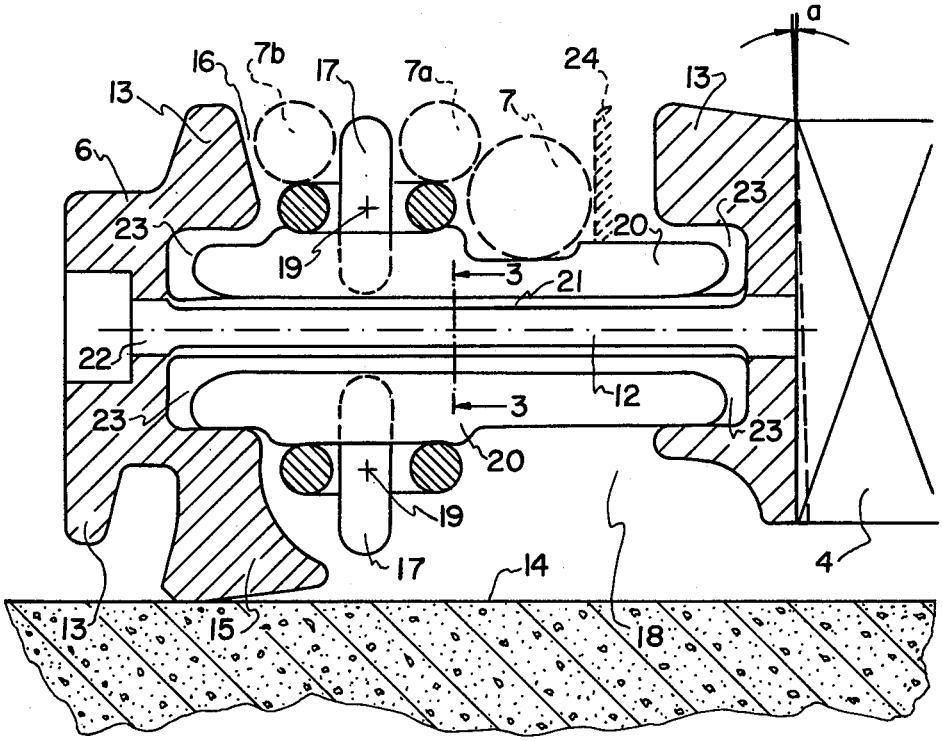
FIG. 2 is a sectional view of a housing, traction member and supply lines of mining equipment according one embodiment of the invention.

FIG. 2 shows in detail the arrangement of the housing and traction means in a first embodiment of the invention. The housing 6 is fastened to the face side of the conveyor 4 by means of screws of bolts 12 which are schematically represented. The housing 6 can include appropriate guide strips and/or grooves 13 for supplementary or exclusive guidance of the extraction machine 5. A lower edge portion 15 of the housing rests on the mine floor 14 and is bevelled because of the tilt angle setting (a) of the conveyor 4.

Provided in the housing 6 is an upwardly open guide channel 16 for an upper run of the traction chain 17 of the extraction machine 5 and a downwardly open guide channel 18 for a lower run of the chain. Support strips 20 are fastened, asymmetrically in this embodiment, to the traction chain 17 at right angles to the axis 19 thereof and at such a spacing from each other that supply lines 7, 7*a* and 7*b* deposited on them do not wipe an intermediate bottom 21 of the housing 6. Bores 22 for the passage of the fastening bolts 12 are provided at spacings in the bottom 21. Longitudinal grooves 23, in which the ends of the support strips 20 are guided, are disposed in the side walls of the guide channels 16 and 18. As a result, the traction chain 17 receives a stable guidance and is secured against displacement and sagging in the upper as well as in the lower run.

The housing 6 can be so constructed that, with the same construction of the guide channels 16 and 18, a symmetrical or asymmetrical fastening of the support strips 20 to the chain 17 can be effected as desired. However, in the case of asymmetrical fastening of the support strips 20, the housing 6 can be adapted thereto, as illustrated by 24 in dashed lines in FIG. 2.

Figure 3:
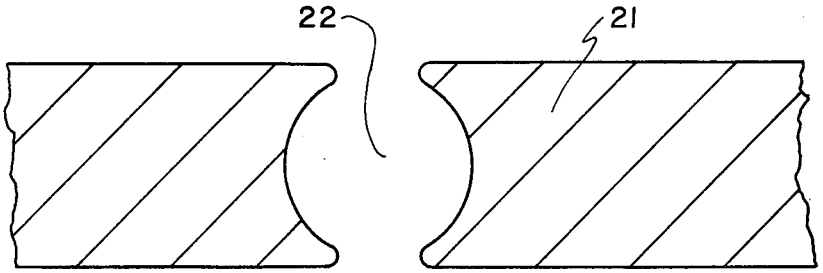
FIG. 3 is a sectional view taken along line 3—3 of FIG. 2.
Figure 4:
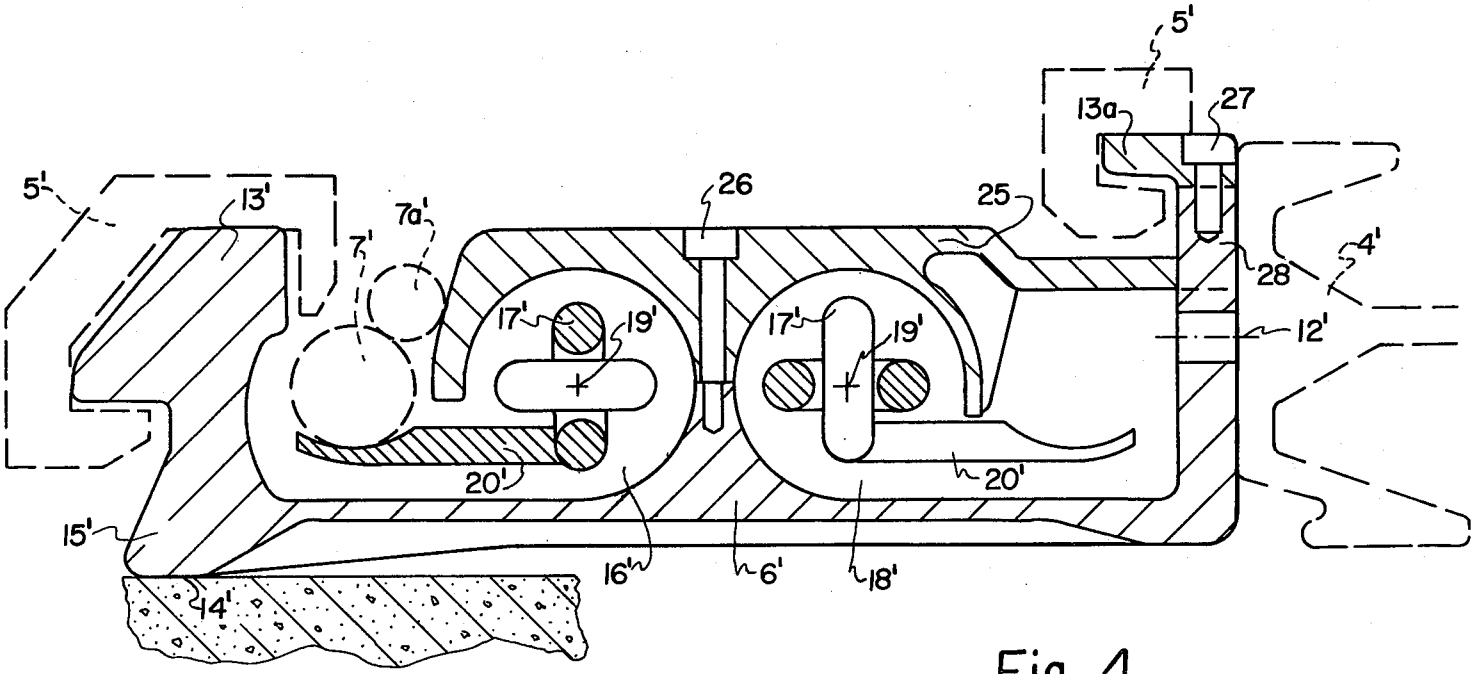
FIG. 4 is a sectional view of a housing, traction member and supply lines of mining equipment according to another embodiment of the invention taken along line 4—4 of FIG. 6.
Figure 5:
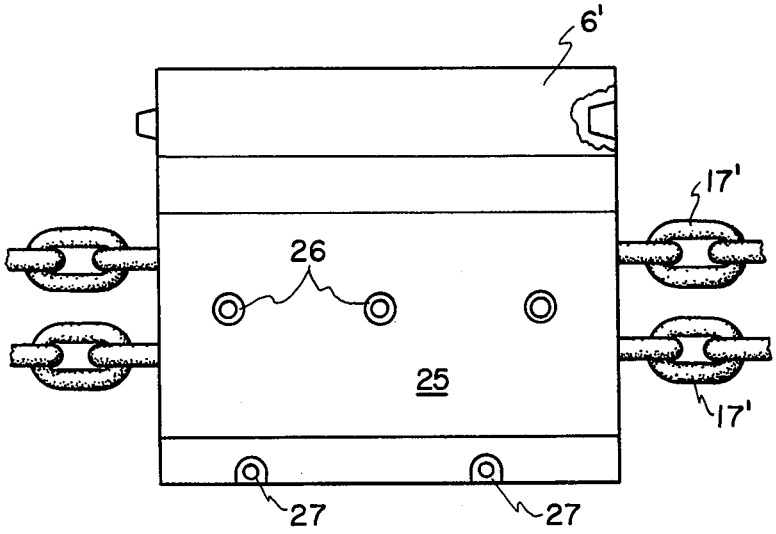
FIG. 5 is a plan view of the housing and traction member shown in FIG. 4.
Figure 6:
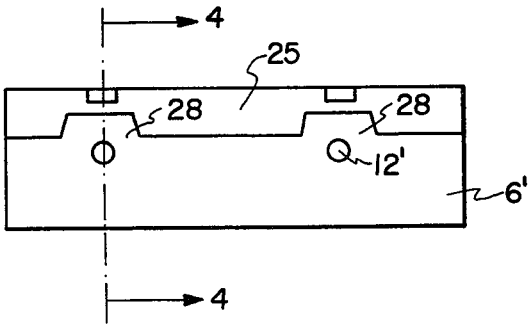
FIG. 6 is a side view of the housing of FIG. 5.

Referring now to FIGS. 4 to 6 there is shown an embodiment in which features corresponding to those of the embodiment of FIGS. 2 and 3 have been identified by corresponding reference numerals. In this case, however, the housing 6' is gutter shaped and is provided with two chain channels 16' and 18', for the load and return runs of the chain 17', arranged side by side. The housing also includes guide strips 13' and **13*a* which is bolted to wall part 28 by bolt 27 for the machine 5' and a lower edge portion 15' which rests on the floor 14' and is bevelled because of the tilt angle setting of the conveying means 4'. The housing is fastened by bolts 12', for example staircase head screws or bolts to the conveyor 4' through housing wall part 28. Support strips 20' are fastened to the chain 17' at right angles to the axis 19' thereof and Cover 25 covers channels 16', 18' and is held to housing 6' by bolt 26. the supply lines 7' and 7*a*' are deposited on the support strips. The channels 16 and 18 are covered by a cover 25. This cover engages over the lengths of the chain 17 guided in the channels 16 and 18 and prevents the chain lengths from whipping out in the event that either should snap. The fastening of the cover to the housing 6 is effected by screws or bolts on the web between the two chain channels and by screws or bolts 27 on the housing edge at the waste side of the housing. In that case, the housing edge at the waste side has protrusions 28 over which the cover 25 engages, as is evident from FIG. 4**.

In a third embodiment according to FIG. 7, the housing 6 is again fastened by bolts 12 to the conveyor 4 at the mining face side thereof and is provided with channels 18 and 16 for the driving and return runs of the traction chain 17 of the winning machine, the channels being arranged one above the other in the housing.

Support strips 20, on which the supply lines 7 and **7*a* are deposited, are fastened to the chain lengths at right angles to the chain axis 19. The support strips comprise U-shaped entraining members, the upper limbs 20' of which engage around the lines 7 and 7*a*** so that these cannot jump out upwardly.

The chain channels 16 and 18 are so covered by the housing that a whipping out of the chain in the event that it snaps is prevented.

For the installation and removal of the chain from housing 6, the chain is drawn as an open strand, from one to the other end of the channels with the aid of an auxiliary rope and the ends are connected to form the endless chain. For this purpose, an angled metal plate 30 for separating the channels 16 and 18 can be removed after loosening bolts 32 holding the plate to the lower part of the housing 6.

Figure 8:
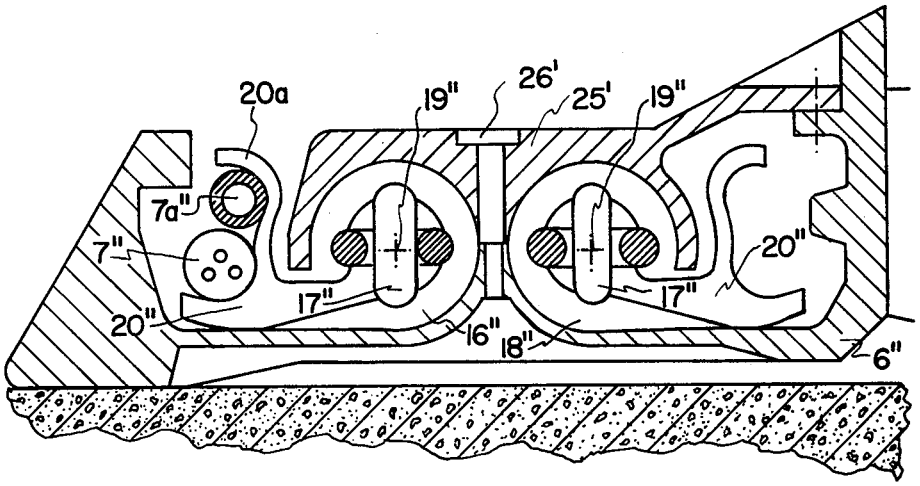
FIG. 8 is a sectional vewi similar to FIG. 7 of a still further embodiment of the invention.

In a fourth embodiment according to FIG. 8, the housing 6'', fastened to the conveyor (not shown), includes channels 16'' and 18'' lying one beside the other for the driving and return runs of the chain 17''. The channels are covered by a cover 25'' detachably fastened to the housing by means of bolts 26'.

The support strips 20'', which are fastened to the chain 17'' at short spacings and on which the supply lines 7'' and **7*a*'' are deposited, are constructed in fork shape, the upper limbs 20*a* of which engage over the lines 7'' and 7*a*'' so that these are secured against jumping out. Laterally, the lines 7'' and 7*a*''** are enclosed by the vertically standing wall of the housing.

Figure 9:
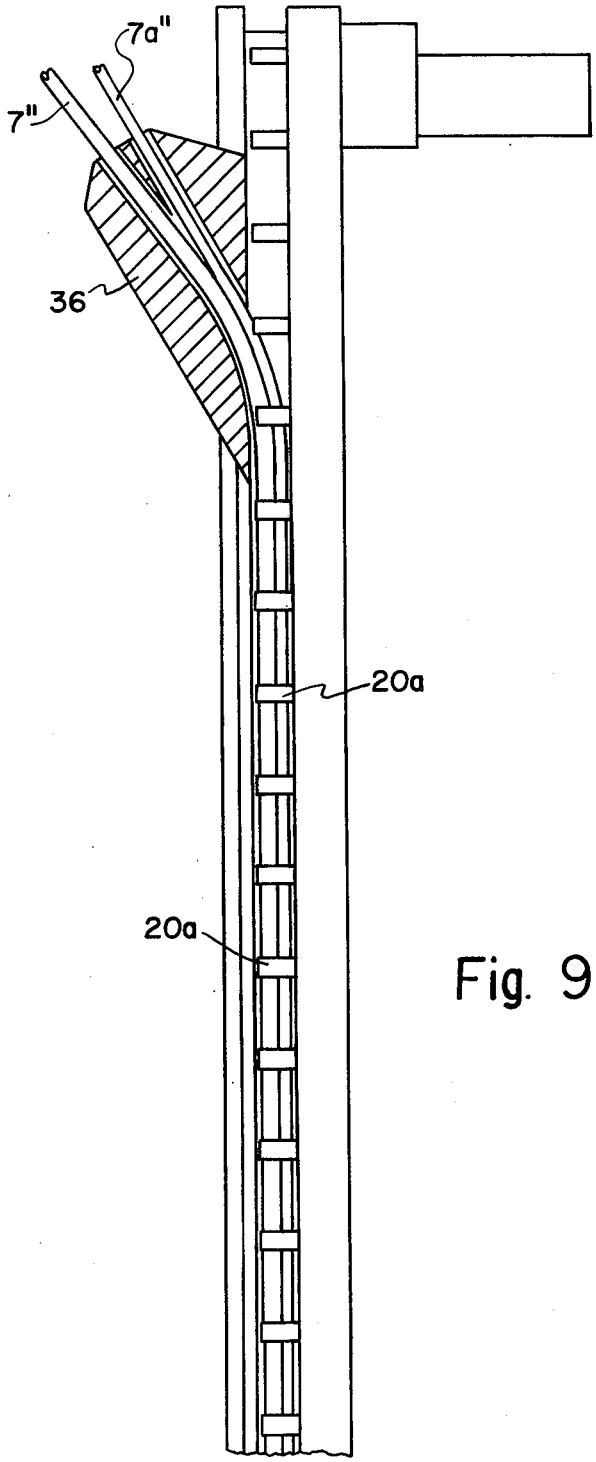
FIG. 9 is a plan view of the equipment of FIG. 7 with guide tracks for the threading in and out of the supply lines.

FIG. 9 shows the threading of the supply lines 7'' and **7*a*'' into and out of the support strips, only the upper limbs 20*a*** of which are shown. The supply lines are guided into or out of the deposit location in guide tracks, which are arranged on the housing.

Line 7'' and **7*a*'' can be individually threaded into strips or forks 20'' by Y-shaped or scissor-shaped guide members 36 which define to conveying passages for the two fine lines, to bring them together and into engagement with strips or forks 20''**.

Figure 7:
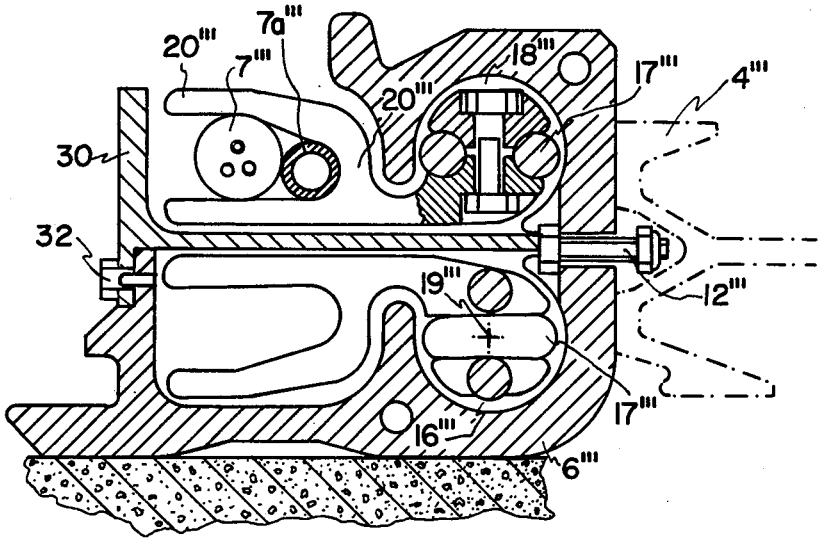
FIG. 7 is a sectional view of a housing, traction member and supply lines of mining equipment according to a further embodiment of the invention.

Other configurations are shown in FIG. 7 where the same parts as in FIG. 2 are shown with the same numerals but with triple primers. Housing 6''', in addition, has a dividing wall 30 held by bolt 32, between channels 16''', 18'''.

While specific embodiments of the invention have been shown and described in detail to illustrate the application of the principles of the invention, it will be understood that the invention may be embodied otherwise without departing from such principles.

What is claimed is:

1. A device for extending at least one supply line to a winning machine in a mining operation having a conveyor line along a longwall with a head drift at one end of the long wall, comprising:

a housing connected to and extending along the conveyor;

said housing defining a pair of separate parallel channels extending along the longwall;

a traction member having an extending run riding in one of said channels and a return run riding in the other of said channels;

a plurality of supply line support elements secured to said traction member and spaced along said traction member for movement therewith for supporting the supply line in said extending run of said traction member; and supply line discharge means positioned in the head drift for extending and withdrawing a supply line as the winning machine moves back and forth along the longwall.

2. A device according to claim 1, wherein said support elements are arranged symmetrically with respect to a longitudinal axis of said traction member.

3. A device according to claim 1, wherein said support elements are arranged asymmetrically with respect to a longitudinal axis of said traction member.

4. A device acccording to claim 1, wherein said support elements extend at right angles to a longitudinal axis of said traction member.

5. A device according to claim 1, including a guideway for the supply line connected to said housing adjacent an end thereof defining separate channels for the infeed of the supply line to said supporting element.

6. A device according to claim 1, wherein said traction member is connected to said winning machine, said housing defining a guideway for said winning machine, the winning machine riding on said guideway along the length of the longwall, said traction member adapted to move the winning machine along the longwall and comprising an endless member.

7. A device according to claim 6, wherein said channels include longitudinally extending grooves in which said support elements travel.

8. A device according to claim 6, wherein said channels are positioned one above the other in said housing.

9. A device according to claim 8, wherein said housing is shaped to include a portion extending over each run of said traction member and leaving a lateral opening for access to each channel and said supporting elements moving with said traction member.

10. A device according to claim 8, wherein said housing includes a removable plate separating said channels from each other.

11. A device according to claim 6, wherein said channels are positioned side by side in said housing.

12. A device according to claim 11, wherein said housing includes a gutter-shaped base portion defining a lower part of said channels and a cover portion connected to said base portion defining an upper part of said channels.

13. A device according to claim 11, including a cover member connected to said housing and covering at least a portion of each of said channels and leaving lateral openings facing in opposite directions for each of said channels, said supporting elements extending in opposite directions and outwardly from said cover in said extending run and return run respectively.

14. A device according to claim 1, wherein said supporting elements are each fork-shaped having a lower leg portion for supporting the supply line and an upper leg portion for overlying the supply line and confining movement of the supply line in said housing.

* * * * *